United States Patent [19]

Head

[11] 3,999,756

[45] Dec. 28, 1976

[54] TENNIS RACKET

[75] Inventor: Howard Head, Baltimore, Md.

[73] Assignee: Prince Manufacturing, Inc., Princeton, N.J.

[22] Filed: Sept. 10, 1975

[21] Appl. No.: 612,076

Related U.S. Application Data

[63] Continuation-in-part of Ser. No. 516,550, Oct. 21, 1974, abandoned.

[52] U.S. Cl. ..... 273/73 C; 273/73 D

[51] Int. Cl.[2] ..... A63B 49/02

[58] Field of Search ..... 273/73 R, 73 C, 73 D, 273/73 F, 73 H, 29 A, 67 R

[56] References Cited

UNITED STATES PATENTS

| | | | |
|---|---|---|---|
| 801,246 | 10/1905 | Johnson | 273/73 D |
| 1,539,019 | 5/1925 | Nikonow | 273/73 R |
| 2,164,631 | 7/1939 | Abell | 273/73 H |
| 3,086,777 | 4/1963 | Lacoste | 273/73 H |
| 3,305,235 | 2/1967 | Williams | 273/73 CX |
| 3,515,386 | 6/1970 | Mason | 273/73 R |
| 3,545,756 | 12/1970 | Nash | 273/73 D |
| 3,801,099 | 4/1974 | Lair | 273/73 C |
| 3,820,785 | 6/1974 | Occhipinti et al. | 273/73 D X |
| 3,917,267 | 11/1975 | McGrath | 273/73 C |

FOREIGN PATENTS OR APPLICATIONS

| | | | |
|---|---|---|---|
| 178,843 | 6/1954 | Austria | 273/73 C |
| 848,826 | 8/1970 | Canada | 273/73 C |
| 427,206 | 4/1935 | United Kingdom | 273/73 R |
| 755,257 | 8/1956 | United Kingdom | 273/73 R |

*Primary Examiner*—Richard J. Apley
*Attorney, Agent, or Firm*—Seidel, Gonda & Goldhammer

[57] ABSTRACT

The tennis racket has a strung surface which is larger than the strung surface of a conventional racket, particularly in regard to its dimension in a longitudinal direction from the frame tip toward the handle shaft of the racket. The conventional length, weight, and balance which have proven necessary for good playing characteristics for all tennis rackets of the past have been maintained. The racket has unexpectedly achieved increased strength and a combination of advantages in playing characteristics without resort to weights, springs, or other complications previously proposed. The racket has a zone of high coefficient of restitution, much larger than that of conventional rackets, extending in a longitudinal direction from the region of the center of percussion to a point 1¼ inch from the throat of the racket, thereby taking maximum advantage of the location of the center of percussion of the racket. The zone of high coefficient of restitution is also wider with respect to the corresponding zone on conventional rackets.

18 Claims, 19 Drawing Figures

FIG. 5A
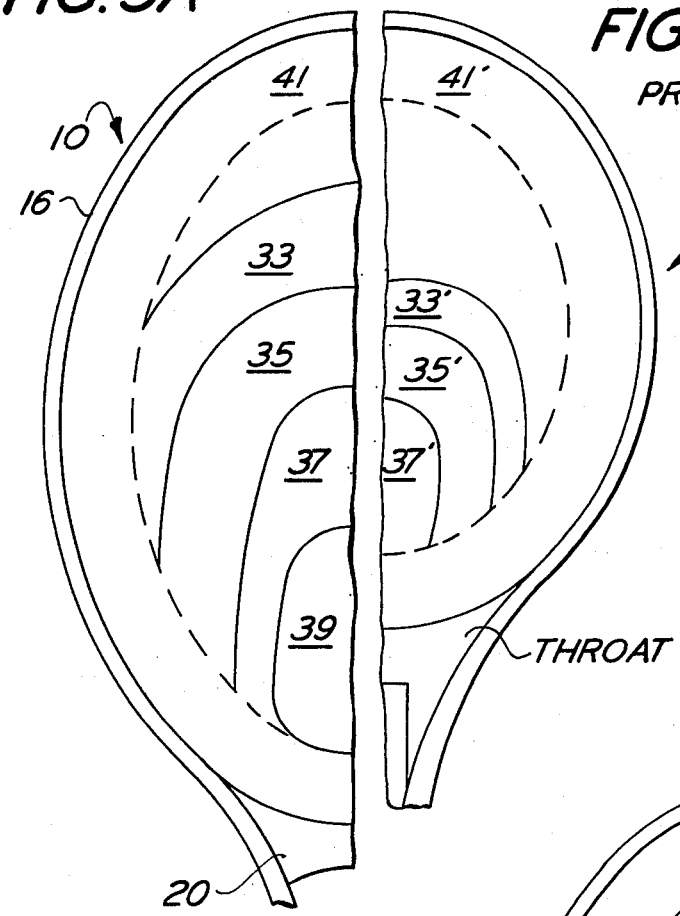
FIG. 5B
PRIOR ART
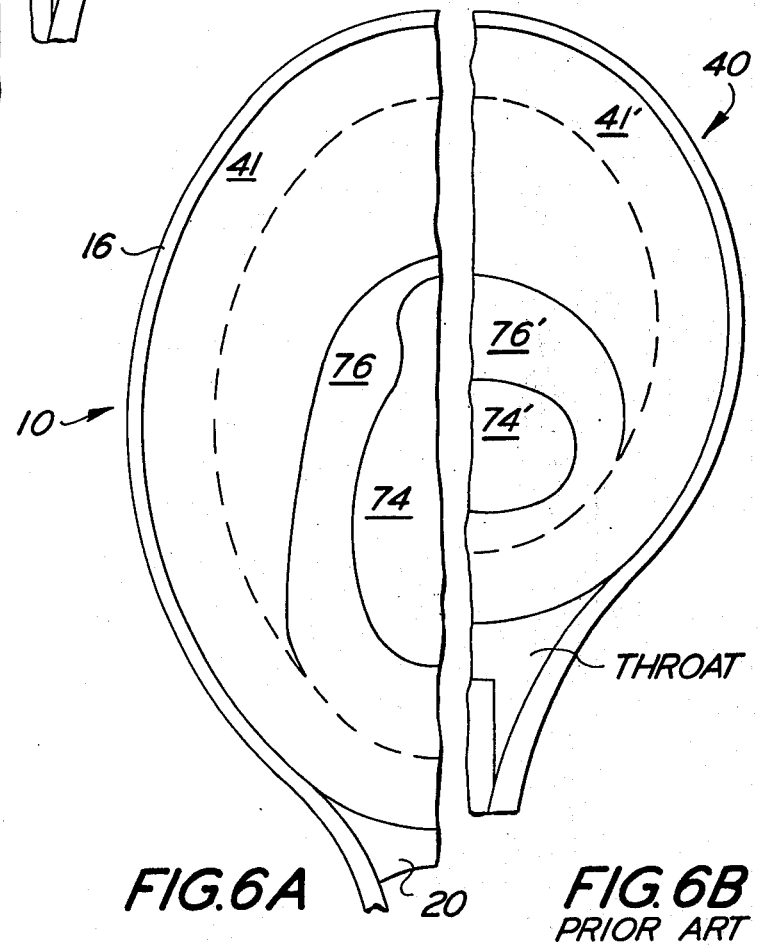
FIG. 6A
FIG. 6B
PRIOR ART

TENNIS RACKET

COPENDING APPLICATION

This application is a continuation-in-part of my co-pending application Ser. No. 516,550 filed on Oct. 21, 1974 on Tennis Racket, now abandoned.

BACKGROUND

Substantially all tennis rackets in general use today have a plurality of characteristics which have proven to be positive in effect, other characteristics found to have a negative effect, and still other characteristics which are considered to be neutral in their effect.

Size — Substantially all tennis rackets in practical use today employ a strung surface of approximately 70 square inches. In most cases, the head is elliptical with the strung surface having a longitudinal axis of approximately 10½ inches and a minor axis of approximately 8½ inches. This relatively small strung surface is believed to be disadvantageous from a playing standpoint, particularly in making no attempt to use the size and location of the strung surface to centralize the center of percussion of the racket and from several other standpoints as will be made clear hereinafter.

Center of percussion —to The designation "center of percussion", sometimes called the "sweet spot", is an important concept in tennis racket design. For the purposes of this disclosure, the "center of percussion" of the racket is the location at which an impacting ball results in zero kick or jar to the player's hand. A disadvantage of racket proposed heretofore and in common use today is that the center of percussion is close to the throat and is spaced from the intersection of the major and minor axes of the strung surface. For example, see U.S. Pat. 1,539,019 which suggests the use of weights added to an otherwise light racket to change the location of the center of percussion. A conventional racket having a center of percussion relatively close to the throat of the racket is undesirable from several viewpoints. The average player tends to strike a ball at the geometric center of the racket and hence at a location spaced from the center percussion.

Coefficient of restitution — The coefficient of restitution is the ratio of the relative incoming velocity of the ball as struck by the racket as compared with its outgoing velocity after impact. Players perfer a racket designed such that their average strokes impact an area of maximum coefficient of restitution in order to obtain the greatest possible return velocity to their shots without having to swing the racket harder and thereby risking loss of control and accuracy.

Strength — A disadvantage of most tennis rackets in general use today, whether made of wood or metal, is their tendency to break. The breakage most often occurs in the shaft of the racket just below the head or in the flare of the racket just above the throat.

Strings — The only two materials in common use today for the stringing of tennis rackets are nylon and animal gut. Of the two materials, nylon has the advantage of being approximately one third the cost, of being weatherproof, and being two to three times more durable as compared with gut. On the other hand, gut is unmistakably the preferred material for use by players of medium-to-expert ability in the case of conventional rackets where the relatively short strings require a material of maximum elasticity and resilience. There has long been a great need for a racket which utilizes strings of nylon or other synthetic or composite materials but which produces substantially the same feel as animal gut when the racket is in use.

DISCLOSURE

The tennis racket of the present invention includes a frame having a head connected to a handle grip so as to have an overall length of 26 to 28 inches, with the optimum length being 27 inches, and a weight of 12 to 15 ounces. The head has a strung surface and its inner periphery defines an area of between about 85 to 130 square inches. The length of the strung surface in a direction along the longitudinal axis of the racket is between 12 and 15 inches while being between 45 and 58% of the total racket length. The strung surface has transverse dimensions, that is perpendicular to the longitudinal axis, of between 9½ and 11½ inches. Due to the increased length of the strung surface in a direction from the tip toward the handle, the center of percussion on the strung surface is proximate to the geometric center thereof.

In a preferred embodiment of the racket of the present invention, the stringing pattern is non-uniform. Strings normally adjacent the frame and extending in a longitudinal and transverse direction have been eliminated. Further, strings adjacent the geometric center of the playing surface are closer together as compared with the spacings of strings closest to the frame of the racket. This non-uniform stringing pattern not only saves stringing material by spacing the strings most widely where they are least used, and concentrating them in the middle of the strung surface where they are most used, but also produces an unexpected and advantageous effect. A string close to the side of the frame is shorter and therefore stiffer in feel. The strings crossing near the geometric center of the racket are longest and therefore softest in feel. By the nonuniform string spacing in which the shorter strings are fewer in number and the longer strings intersecting at the center of the racket are more closely space with respect to an impacting ball, there results an increase in uniformity of feeling of stringing tension over the entire face of the strung surface.

A racket in accordance with the present invention overcomes various disadvantages of the prior art while at the same time producing a variety of desirable results. The increased size of the playing surface, particularly the aspect of its length in a direction from the tip towards the handle end of the racket, has the results of producing or achieving: circumscription of the center of percussion, a larger zone of high coefficient of restitution, an average more accurate return of shot by the player, an increased polar moment of inertia about the longitudinal axis, a greater ease of applying spin to the ball, a longer "dwell time" in which a returned ball is in contact with the strings for greater control, and greater strength to the racket. All of these concepts will be further amplified in the ensuing disclosure. The nonuniform stringing pattern discussed above adds further increments to all of these useful advantages.

It is an object of the present invention to provide a tennis racket of standard length, weight, and balance structurally interrelated in a manner so as to have a substantially increased length of strung surface particularly in the direction from the tip toward the handle end of the racket.

It is another object to provide a tennis racket wherein the center of percussion is close to the geometric center of the strung surface and has a larger zone of high coefficient of restitution.

Other objects will appear hereinafter.

For the purpose of illustrating the invention, there is shown in the drawings a form which is presently preferred; it being understood, however, that this invention is not limited to the precise arrangements and instrumentalities shown.

FIGS. 5A and 5B are a diagrammatic comparison of test results on the racket of this invention and a conventional racket with respect to the coefficient of restitution.

FIGS. 6A and 6B are a diagrammatic comparison of test results on the racket of this invention and a conventional racket with respect to the angle of ball return.

Figure 1:
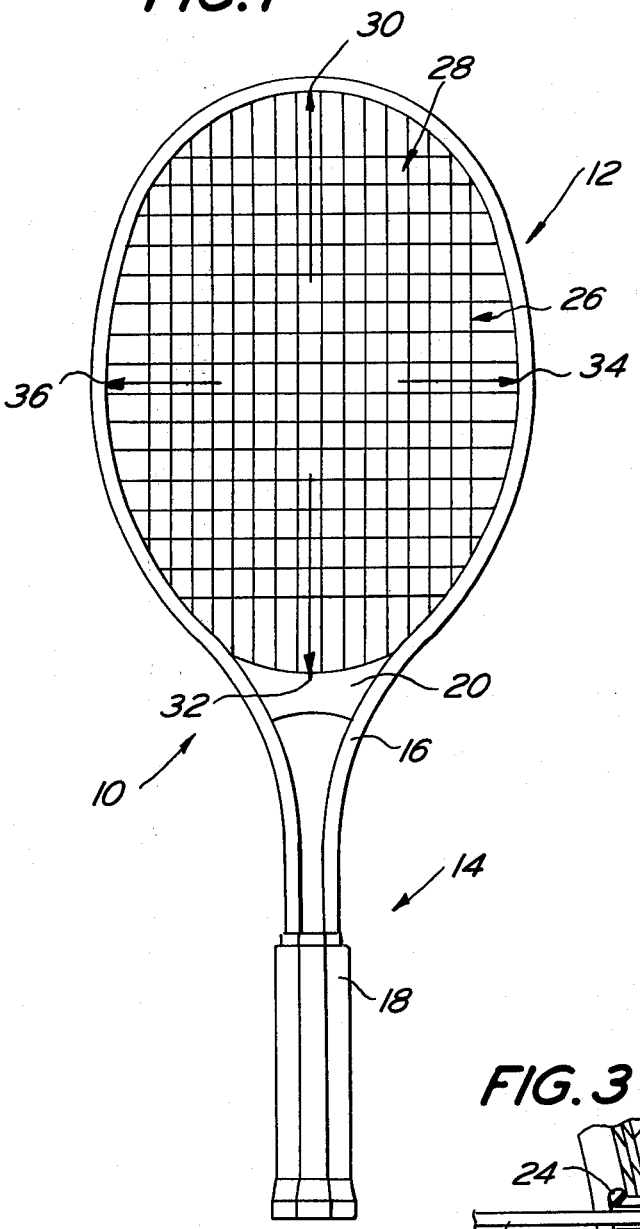
FIG. 1 is a plan view of a tennis racket in accordance with the present invention.
Figure 2:
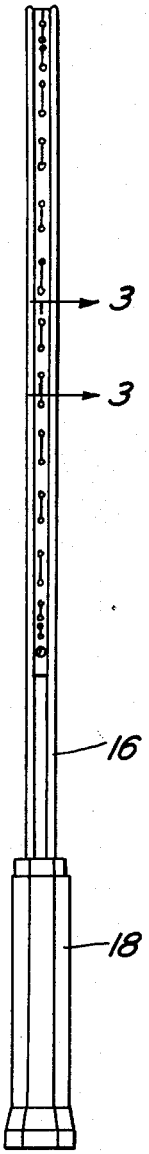
FIG. 2 is a side view of the tennis racket in FIG. 1.

Referring to the drawings in detail, wherein like numerals indicate like elements, there is shown in FIG. 1 a tennis racket in accordance with the preferred embodiment of the present invention designated generally as 10. The racket 10 includes a head 12 and a handle shaft 14.

The racket 10 includes a frame 16 preferable made from a hollow extruded high strength aluminum alloy. Frame 16 is bent into the desired configuration so as to have a loop defining the head 12 and parallel ends which are secured to the handle grip 18. The grip 18 is fabricated of lightweight material such as plastic with leather or other suitable covering and is made in a variety of sizes for different player preferences.

The racket 10 includes a throat 20. The throat 20 is secured within frame 16 to provide a suitable lower completion of the generally elliptical strung surface. The throat 20 is pierced with holes matching holes in the frame 16 to provide the basis for accomplishing a stringing pattern. The throat 20 may be made from a high strength polymeric plastic material. All portions of frame 16 in the region of the strung surface have a radius of curvature of 3 to 10 inches except for a small portion thereof at the flare of the throat.

Figure 3:
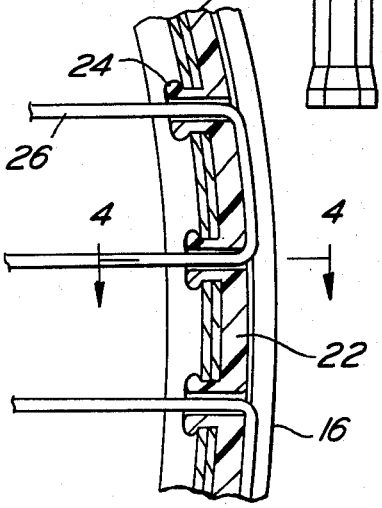
FIG. 3 is a sectional view taken along the line 3—3 in FIG. 2.
Figure 4:
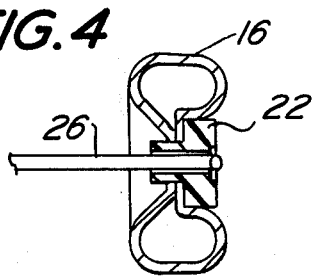
FIG. 4 is a sectional view taken along the line 4—4 in FIG. 3.

The channel formed on the outer periphery of frame 16 may be provided with a grommet strip 22 having grommets 24 integral therewith. The grommets 24 extend through the holes in the frame 16 whereby the strings 26 may be threaded through adjacent grommets and partially extend around the grommet strip 22. See FIGS. 3 and 4. The strip 22 is preferably made from a high strength polymeric plastic material with sufficient resilience to provide a cushioning for the strings 26 so that they will not cut when they extend through the holes in the frame.

The strings 26 are preferably a standard commercially available nylon material or other synthetic or composite material. The webbing strings 26 are preferably of synthetic material such as nylon because of its low cost, high durability and because of it weatherproof nature, and because it is well adapted to the racket of this invention where a synthetic material of longer average string length is found to provide a resilience similar to animal gut when gut is used in the shorter stringing length of conventional rackets. However, animal gut may still be used in the racket of this invention where preferred by individual players.

The throat 20 cooperates with the frame 16 to define a generally elliptical area containing the strung playing surface 28. The length of the strung surface 28 is defined by the numerals 30, 32. The width of the strung surface 28 is defined by the numerals 34, 36. The length of the strung surface 28 is between 12 and 15 inches while being between 45 and 58% of the total racket length. The width of the strung surface 28 is between 9½ and 11½ inches.

The racket 10 has a weight of between 12 and 15 ounces with an overall length of between 26 and 28 inches. The preferred embodiment of racket 10 has an overall length of 27 inches. The center of percussion (CP) is located at or proximate to the geometrical center of the playing surface 28. The center of gravity (CG) of the racket 10 is located at a point between 45 and 52%, and preferably approximately 48% of the total length of the racket 10 as measured from the butt end of the handle shaft 14 so as to be at or adjacent the throat 20.

The head 12 in the preferred embodiment has an inner periphery defining a strung area which is approximately 112 square inches (length about 13½ inches, width about 10½ inches) or about 60% larger than the average corresponding area of a conventional racket. The length of surface 28 must be at least 10% greater than its width. The racket 10 has high strength attained by the structural construction of the frame 16 in combination with other strength advantages inherent in the use of a racket structurally interrelated as set forth herein while being of standard length and weight.

In the preferred embodiment, a pair of main webbing strings 26 are arranged in the center located symmetrical with the longitudinal axis of the racket 10 spaced from one another at a center-to-center distance of about .42 inches. Disposed outwardly from the two center strings 26, seven additional strings 26 are arranged such that their center-to-center distance progressively increases in the following preferred sequence .44 inches, .46 inches, .48 inches, .50 inches, .53 inches, .57 inches and .61 inches. This arrangement leaves two unstrung cordal segments along the sides of the frame 16 each of which has a height of approximately 1½ inches.

In a similar manner, the transverse or cross strings 26 are arranged with three in the center with a center-to-center distance of .42 inches. Thereafter, both in the direction of the tip of the racket 10 and in a direction toward the throat 20, eight additional strings are employed such that their center-to-center distance progressively increases in the following preferred sequence. The fist additional string is .44 inches from the three central string 26, the second string is at .46 inches, the third at .48 inches, the fourth at .50 inches, the fifth at .53 inches, the sixth at 57 inches, the seventh at .61 inches, the eight at .66 inches. As will be seen from FIG. 1, this arrangement leaves an unstrung cordal segment, at the tip of about 1½ inches and a height of about 1¾ inches at the throat. No attempt has been made to accurately illustrate this stringing pattern in FIG. 1 in view of the small dimensions involved.

The preferred stringing pattern described above utilizes 19 strings in a transverse direction and 16 strings in the longitudinal direction. This arrangement requires approximately 40 feet of stringing material with ample allowance for overlaps and wastage by the stringing mechanic. The total length of stringing material required for the racket 10 is only 25% greater than that required by a conventional racket while at the same time the area of the strung surface of the preferred embodiment of racket 10 is 60% greater than that of a conventional racket. Compare the relative sizes of the heads in FIGS. 8, 10 and 12, 14. The preferred tension for strings 26 is 65–70 lbs.

As will be apparent from the above description, the spaces between strings adjacent the geometric center of the strung surface 28 are smaller than those closest to the frame 16. This stringing pattern produces a more uniform feeling of resilience across the entire face of the racket for reasons previously explained. If desired, the conventional uniform spacing of strings 26 may be used.

The center of percussion is the point on the racket's surface where the entire energy of the stroke goes into return of the ball and none is wasted by the transmission of jar to the player's hand. On a conventional racket, the center of percussion is approximately equidistant from the throat and the geometric center of the playing surface or is closer to the throat. Attempts have been made to correct this deficiency by the use of weights to shift the center of percussion toward the tip of the racket head. However such designs have failed to achieve practical use since the balance of such rackets becomes altered producing a "head heavy" feel objectionable to tennis players.

This inventor uses a different approach. Recognizing that the center of percussion must remain fixed with respect to its geometric position along the longitudinal axis of the racket if the racket is to maintain good balance, my solution is to increase the length of the strung surface toward the handle in order to surround this unalterable location of the center of percussion and extend therebeyond for at least 80% of the distance between the center of percussion and the center of gravity. The center of percussion (CP) of racket 10 has been shown by laboratory tests to lie at a point on the longitudinal axis of the racket about 19 to 20 inches from the butt end of the handle shaft 14 and therefore is adjacent the geometric center of the strung surface 28. Rackets having a strung surface with the above-mentioned range 85 to 130 square inches will have their center of percussion spaced from the geometric center by a distance of zero to one inch.

Figure 7:
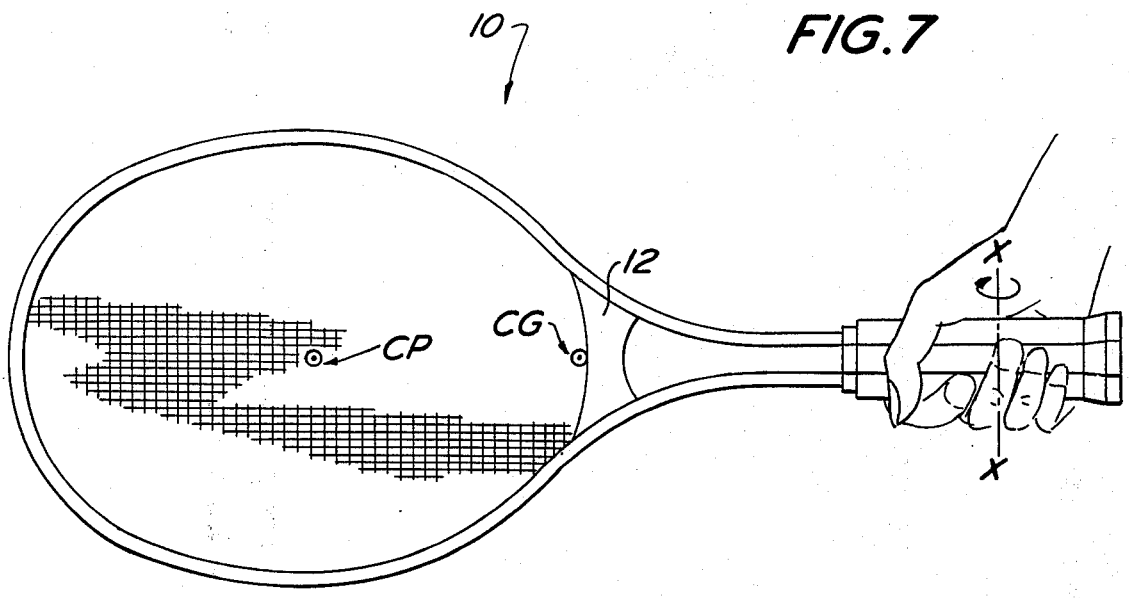
FIG. 7 is a diagrammatic view of the present racket being held by a hand.

In testing for the location of the center of percussion, it was assumed that the center of rotation is at a point 3 inches from the butt end of the handle as indicated by the line X—X in FIG. 7 which is the point at which the racket tends to rotate with respect to the player's hand, and that the flexibility of the player's hand and wrist, no matter how strong the player, is much greater than the flexibility of any portion of the racket.

The "coefficient of restitution" briefly alluded to in the foregoing is an important concept in the refinement of tennis racket design. Coefficient of restitution as applied to tennis rackets is the ratio of the relative velocity of the incoming ball as it meets the racket with respect to its resulting return velocity. For example, if a ball moving 50 mph strikes a motionless racket and if found to return at 50 mph, the racket would be said to have a coefficient of restitution of 1.0. If the oncoming ball again has a velocity of 50 mph and if the racket is moving in the opposite direction at 10 mph, then the return velocity must be 60 mph in order that the coefficient of the racket be 1.0 . The above examples are for explanation only.

The ranges of coefficient of restitution obtainable on conventional tennis rackets is generally in the order of 0.3 to 0.5. As will be seen below, the racket 10 of this invention develops higher coefficients of restitution than conventional rackets. It is clear that the largest possible zone of high coefficient of restitution will be of great advantage to a tennis player. His return shots will then have more velocity with the same power of swing, or alternatively he can slow down his swing for greater control and still obtain satisfactory velocity on his return shot. The zone of optimum coefficient of restitution will lie in the region between the center of gravity and the center of percussion.

High speed motion pictures were taken in an effort to find the coefficient of restitution of points approximately one inch apart on the preferred embodiment of the racket 10 of this invention and a conventional racket constructed of the same materials. A calibrated air-pressure ball shooting machine was used to propel the balls a distance of 5 feet toward the racket faces. In all tests, parallel data was established under identical conditions for the preferred embodiment of the racket of this invention and compared with the conventional racket. Zone lines for both types of rackets were established for coefficients of restitution greater than .30, greater than .40, greater than .50. The tests, conducted with a camera at a frame speed of approximately 400 frames per second, charted the incoming velocity of the ball as compared with its return velocity. Various incoming ball velocities were employed varying from aproximately 60 miles per hour to approximately 30 miles per hour. Both the incoming and return velocities of the ball were readily observable from this high-speed photography technique and it was further possible to measure precisely the location of each impacting ball.

In one test, the rackets were mounted vertically disposed in a vise simulating a player's hand. This test setup was used most extensively because of its inherent characteristic of assurance of uniformity and reproducibility. However, additional tests at the same camera speed were also conducted on hand held rackets and on rackets supported on blocks simulating a "free space" condition where there would be no defined center of rotation. In all tests, it was established that the effective playing surface of a racket must be considered to terminate at a zone designated 41, 41' located 1¼ inch inside the frame of the racket (whether the racket of this invention or a conventional racket). In zone 41 or 41', the ball strikes the frame or throat of the racket.

Film frames were analyzed one by one to determine the return velocity. The coefficient of restitution of points approximately one inch apart were plotted, using powdered chalk on the ball to prove the point of impact. A composite of tests dealing with coefficient of restitution is shown in FIG. 5. In FIG. 5A, the zones of coefficient of restitution as established by the laboratory tests are shown for the preferred embodiment of the racket of this invention. In FIG. 5B, the same zones of coefficient of restitution are shown as determined for a conventional racket under the same test conditions. The zones on the respective rackets were for all practical purposes symmetrical about the longitudinal axes of the rackets.

As shown in FIG. 5A, zone 33 represents a coefficient restitution greater than .30 for the racket of this invention and is substantially larger (approximately four times as great in area) than zone 33' representing the extent of a coefficient of restitution greater than .30 for the conventional racket. In a similar manner, zone 35 and 35' map coefficients of restitution greater than .40 . It will be seen that zone 35 for the racket of this invention is substantially larger (approximately four times as great with an area of about 20 square inches) than zone 35' for the conventional racket which was found to have an area of only about 5 square inches. Similarly, zones 37 and 37' which map coefficients of restitution of greater than .50 show a similar advantage of the racket of this invention over the conventional racket.

The average size of the corresponding zones for the racket of this invention was found to be 3.78 times as great as those of a conventional racket. This 3.78 times increase is remarkable in view of the fact that the strung surface 28 is only 60 % larger than the strung surface on a conventional racket. This increase in size of the zones was noted to be a combination of increased length and width.

Finally, zone 39 which represents a coefficient of greater than .60 has a substantial area (more than 4 square inches for unrestrained racket and ball speed of 38.5 mph and more than 8 square inches when ball speed increases to 60 mph) for the racket 10 of this invention while being found not to exist at all on the conventional racket 40. On the racket 10, the favorable coefficient of restitution greater than .4 was found to extend from the region of the center of percussion toward the region of the center of gravity. In all cases, it will be seen that the contour lines mathematically developed from the test data terminate abruptly at zone 41, 41' located 1¼ inches inside the frame of the rackets. From this fact, it will be clear that embodiments of the racket of this invention larger than the preferred embodiment will show still greater advantage over a conventional racket with respect to larger zones of favorable coefficient of restitution.

A well known concept in tennis instruction and development of proficiency of play, deals with the concept of maximizing the "dwell" period of the ball on the strings of the racket as the ball is stroked. With a conventional racket, the "dwell" can only be increased by encouraging the player to follow through while stroking the ball in order to maintain contact between the ball and the strings of the racket for the maximum possible time to thereby increase the stability and accuracy of the return shot.

Figure 8:
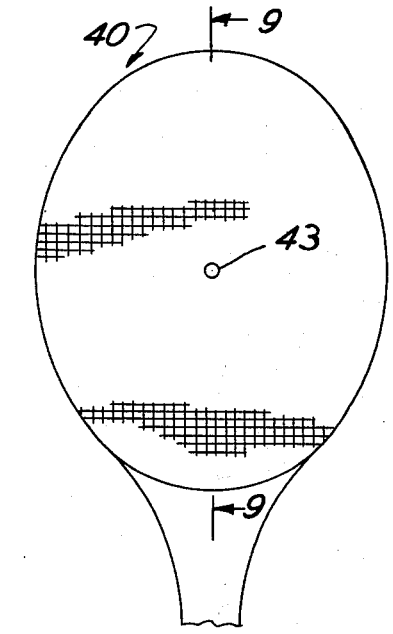
PRIOR ART FIG. 8
FIGS. 8 and 12 are diagrammatic plan views of a head of a conventional racket.
Figure 9:
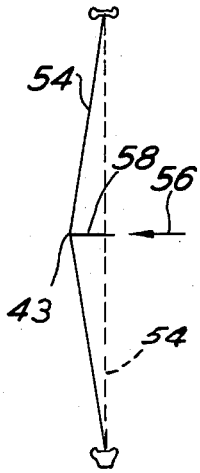
FIG. 9 PRIOR ART
FIG. 9 is a diagrammatic view of a string at impact as seen along the line 9—9 in FIG. 8.

This inventor believes that an important advantage of the racket 10 of the present invention is that the "dwell" is automatically increased by the inherent geometrical construction of the racket 10. In FIG. 8, let it be assumed that the ball strikes the strings of a conventional racket 40 at the point 43 while traveling in the direction of arrow 56. As shown in FIG. 9, the web strings 54 is deflected at a point 43 by a distance identified by the numeral 58.

Figure 10:
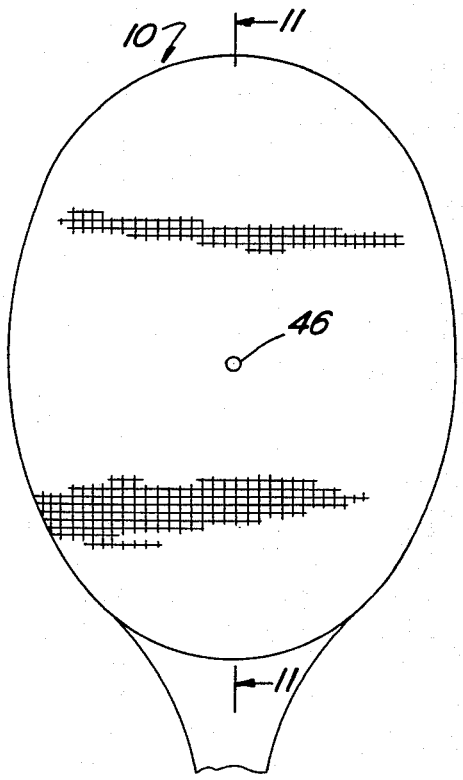
FIGS. 10 and 14 are diagrammatic plan views of a head of a racket in accordance with this invention.
Figure 11:
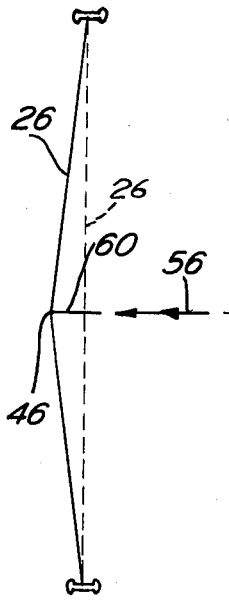
FIG. 11 is a diagrammatic view of a string at impact as seen along the line 11—11 in FIG. 10.

Referring to FIG. 10, let it be assumed that the same ball strikes the strings 26 on the racket at point 46 while the ball is traveling in a direction of arrow 56. Further, it is assumed that the points 43 and 46 lie at the geometrical center of the strung surfaces of the respective rackets. As shown in FIG. 11, the deflection of point 46 is indicated by the distance 60. The distance 60 is greater than the distance 58 which thereby results in the "dwell" period being greater on the racket 10 of the present invention by approximately 20%.

In connection with FIGS. 8–11, it is assumed that both rackets are strung with the same material at the same tension and that the oncoming ball approaches at the same velocity and is struck with the same power. Further, it is assumed that the strings 26 are 20% longer than the string 54 which assumption is clear from the above disclosure. While the points 43 and 46 are in the exact center of the strung surface on the rackets 10 and 40, it will be clear that the same principles apply when a ball is struck off center. No definitive tests have been performed substantiating increased dwell time due to the difficulty of making accurate measurements. However, subjective reaction in actual play with racket 10 as compared to conventional rackets 40 repeatedly bear out a "feeling" of increased dwell of the ball on the strings and resulting greater control.

The inherent geometrical construction of the racket 10 provides an advantage whereby a player who is less skilled in the art of "follow through" will nevertheless have a better chance of returning a true shot. At the same time, an expert tennis player using the racket 10 of the present invention with fully developed stroking skill will benefit by any increase in "dwell period" achieved in racket 10 to stablilize and increase the accuracy of his return stroke.

Figure 12:
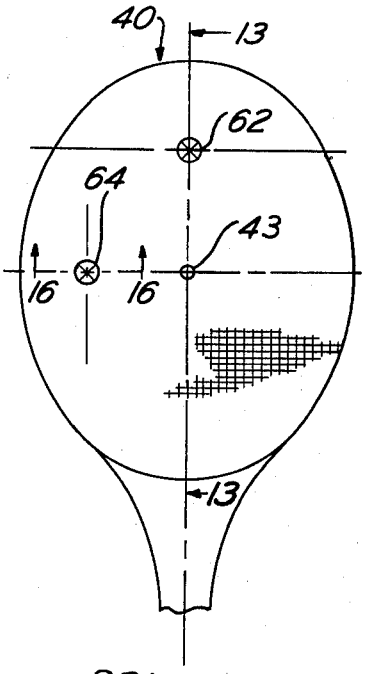
PRIOR ART FIG. 12
Figure 13:
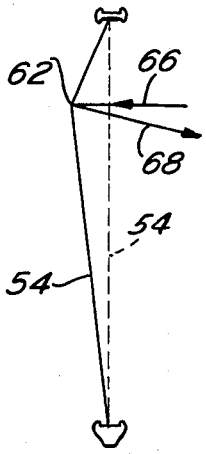
FIG. 13 PRIOR ART
FIG. 13 is a diagrammatic view of a string at impact as seen along the line 13—13 in FIG. 12.

The racket 10 of the present invention minimizes the inherent error of angle of return due to deflection of the ball when the ball strikes the strung surface 28 off its geometric center. A disadvantage of conventional racket 40 is that a ball struck off center tends to be returned at an angle materially differing from its incoming trajectory. See FIGS. 13 and 16. In FIG. 12, let it be assumed that a ball strikes the strung surface on the racket 40 at a point 62 which lies along the longitudinal axis of the racket but is spaced from the geometric center of the strung surface. As shown in FIG. 13, a ball striking point 62 with an incoming trajectory indicated by arrow 66 leaves the point 62 with a trajectory indicated by the arrow 68. The angle defined by arrows 66, 68 is slightly exaggerated for the purposes of illustration.

Figure 14:
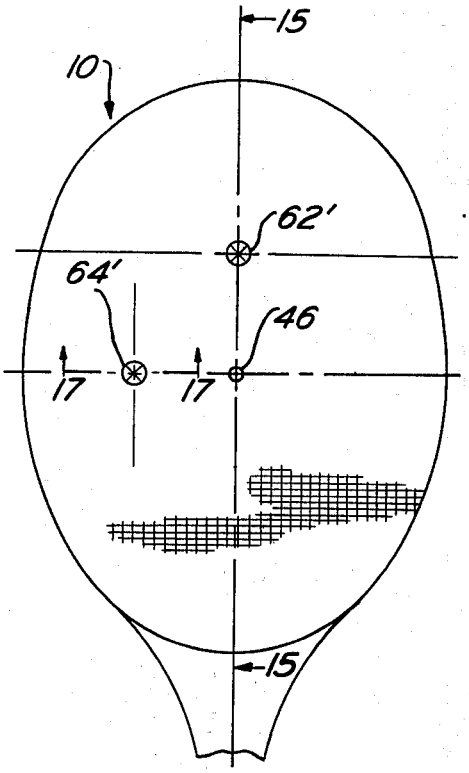
Figure 15:
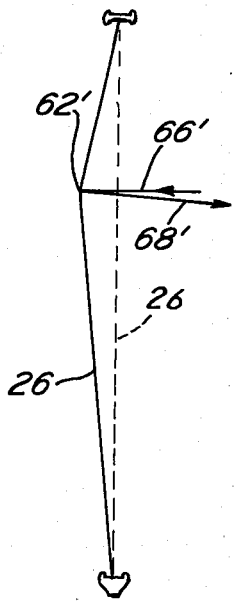
FIG. 15 is a diagrammatic view of a string at impact as seen along the line 15—15 in FIG. 14.

On the racket 10 in FIG. 14, point 62' is on the longitudinal axis thereof and spaced from the geometric center of the strung surface by the same distance as point 62. As shown in FIG. 15, an incoming ball having the trajectory of arrow 66' will strike point 62' and depart with a trajectory indicated by the arrow 68'. The included angle between the arrows 66' and 68' is less than the included angle between arrows 66 and 68. As a result thereof, the return show with the racket 10 of the present invention is more accurate than that with racket 40.

Figure 16:
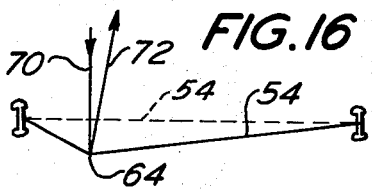
FIG. 16 is a diagrammatic view of a string at impact as seen along the line 16—16 in FIG. 12.
Figure 17:
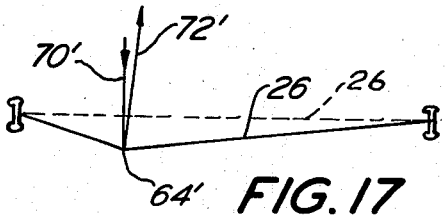
FIG. 17 is a diagrammatic view of a string at impact as seen along the line 17—17 in FIG. 14.

In FIG. 12, racket 40 is provided with a point 64 which does not lie along the longitudinal axis. In FIG. 14, a similar point 64' is provided on the racket 10. The distance between point 64 and 64' and the center of the strung surface of the respective rackets is the same. As shown in FIG. 16, the included angle between the arrows 70 for the incoming trajectory and the arrow 72 for the outgoing trajectory is greater than the corresponding angle indicated by the arrow 70' indicating an incoming trajectory and arrow 72 indicating the outgoing trajectory in FIG. 17. Thus, the racket 10 of the present invention increases the accuracy of the return of a ball which is struck at a point spaced from the geometric center of the strung surface as compared to a conventional racket 40 for the reasons set forth above.

Comparative laboratory tests were conducted in regard to "angle of return". The majority of the tests were conducted with the racket held horizontally in a vise simulating the hand and with the face of the racket perpendicular to the ground. Emphasis was placed on these vise-held tests due to their inherent reliability and reproducibility. However, for control purposes, considerable additional tests of the same nature were conducted on hand-held rackets. All tests compared the preferred embodiment of the racket of this invention against a conventional racket. Test conditions for both types of rackets were identical. Racket 40 was the same racket used for the tests reflected in FIGS. 5A and 5B.

The tests concerning error of angle or return were conducted at various ball velocities ranging from 38.5 miles per hour to 62.2 miles per hour. Sufficient points were plotted to map the zones on the respective rackets where the error in angle of return was greater than 10 degrees, and greater than 20 degrees. The average of these zones compiled from the various tests is shown in FIG. 6A for the racket 10 of this invention with comparable zones shown in FIG. 6B for a conventional racket 40. Numerals 76 and 76' show respectively the zones where the error in angle of return was less than 20 degrees. Numeral 74 and 74' indicate respectively for the two rackets the zones in which the error in angle of return was less than 10 degrees. From an examination of FIGS. 6A and 6B, it will be seen that the area of the respective zones of equal error of angle of return are in all cases larger for the racket of this invention as compared to a conventional racket. The average zone area is 2.7 times as great for the racket 10 of this invention where the ball is returned with the same accuracy as compared to the comparable zones for conventional racket 40. As in the case of the test data on coefficient of restitution, it will be seen that the operative zones may terminate at the zones 41, 41' located 1¼ inch inside the frame of the racket. Still further improvement in average accuracy of return can be expected in the larger headed embodiments within the scope of this invention.

In general, there are two conditions in which a skilled player consciously arranges his racket so that the impacting ball strikes the webbed surface from a non-perpendicular direction. One such case is an "undercut" or "chip" causing the ball to drop dead with back spin on the opponent's court. The other condition is where a skilled player strikes the impacting ball while the racket face is being moved upwards to impart top spin to the ball so that it lands in the opponent's court with a forward bounding motion which is difficult to return. The upward motion of the racket face results, in effect, in a non-perpendicular impact between the ball and the strung surface. In both cases, it will be clear that the longer dwell time during which the ball is in contact with the strings, provides more time for the returned ball to acquired angular acceleration, increasing the amount of backspin, or top spin, as the case may be. This effect is further augmented by the simple fact of the increased width of the strung surface in that there is more transverse room, as well as time, for the ball to roll across the racket strings 26, thus picking up greater spin. Experienced players consistently note increased spin on the return ball when struck with the racket 10 of this invention as opposed to that achieved from the smaller strung surface of a conventional racket. The same increased spin is also predictable, and observed in practice while an experienced player elects to employ a "slice serve" or "overspin serve" as opposed to a "flat serve".

A surprising advantage of the racket 10 of this invention is that it is stronger and more durable in actual use than conventional racket 40. Laboratory tests of racket 10 using a tennis ball hitting machine resulted in one racket 10 breaking after 90,000 strokes (this is twice the accepted level for a conventional racket) while another racket 10 was still in good condition when the test was stopped after 100,000 strokes. This highly desirable, and unexpected, increase in strength experienced in the racket 10 of this invention with respect to conventional racket 40, in spite of the increased size of head, appears to be the result of a far greater proportion of balls striking in the zone of high coefficient of restitution circumscribing the center of percussion with the result that less vibration and fatigue is introduced into the racket frame 16 over a prolonged period of play. Regardless of the cause, the increase in strength is a fact proved by test and experience in actual play, and is a great advantage to the tennis playing public which has been inconvenienced and caused expense by the breaking of conventional rackets.

A final advantage of the racket of this invention 10 over conventional racket 40 has been found to be a marked alleviation of the aliment common to tennis players of all classes generally referred to as "tennis elbow" which is an inflammation in the elbow joint caused by twisting of the racket when a ball is struck off center and jar to the player's arm when a ball is struck remote from the center of percussion. A marked alleviation of this ailment has been noticed by a wide variety of players who have tested prototypes of the racket 10 of this invention. This unexpected advantage is believed to follow from the fact that more balls are struck in the region of the center of percussion, eliminating jar from the player's hand, as well as from the fact that the high polar moment of inertia of this wider racket decreases the tendency for the racket to twist when a ball is struck off center. Hence, I believe this racket will be a boon to players who have or are prone to tennis elbow.

In summary, the racket 10 of this invention is of standard length, weight, and balance, and at the same time: (a) the strung surface us 20% to 90% larger than that of a conventional racket, (b) the strung surface is located to centralize the center of percussion. These desirable features are attained without resort to weights, springs, or other complications but instead are attained by increasing the size of the head primarily in the direction of the mid-point of the racket. Thus, the inventor enlarges the strung surface to move the geometrical center of the strung surface toward the center of percussion of the racket instead of attempting to move the center of percussion toward the geometric center of a conventional racket.

While the frame 16 of the racket of this invention is preferably made from extruded aluminum, other types of frames made from wood, fiber reinforced plastic, and other materials having the necessary strength, lightweight and resilience, may be utilized. Other modifications will be apparent to those skilled in the art such as the elimination of the grommets 24, and may be made without departing from the scope of the invention. While the grip 18 is preferably a polymeric plastic material molded onto the ends of the frame 16, other conventional techniques may be utilized for joining the ends of frame 16 to the grip 18. No special equipment is needed for stringing racket 10 whereby it may be sold without strings as is conventional with presently available rackets.

The present invention may be embodied in other specific forms without departing from the spirit or essential attributes thereof and, accordingly, reference should be made to the appended claims, rather than to the foregoing specification as indicating the scope of the invention.

I claim:

1. A tennis racket comprising a frame having a head connected to a handle grip so as to have an overall length of 26 to 28 inches and a weight of 12 to 15 ounces, said head having a strung surface of 85 to 130 square inches, the length of said surface in a direction along the longitudinal axis of the racket being between 12 and 15 inches and between 45 and 58% of the total length of the racket, said surface having a maximum width between 9½ and 11½ inches in a direction generally perpendicular to said axis, the center of percussion of said surface being approximately adjacent the geometric center thereof, and the center of gravity of the racket being at a location between 45 and 52% of the total length of the racket as measured from the butt end of the handle grip.

2. A tennis racket in accordance with claim 1 wherein the racket has a length of 27 inches, said head being generally eliptical with the geometric center thereof being defined by the intersection of the major and minor axis, the periphery of said head being defined by said frame and a throat piece secured to the frame.

3. A tennis racket in accordance with claim 1 wherein said surface is defined by strings closer together in the location of said geometric center as compared with locations spaced therefrom.

4. A tennis racket in accordance with claim 1 wherein said frame is constructed from a member having a substantially FIG. 8 configuration in cross section.

5. A tennis racket in accordance with claim 1 wherein said surface has a zone of high coefficient of restitution circumscribing the center of percussion, the major axis of said zone being generally along the longitudinal axis of said racket, at least a part of said zone having a value greater than .6.

6. A tennis racket comprising a frame having a head connected to a handle grip so as to have an overall length of 25 to 28 inches, said head having a strung playing surface of 85 to 130 square inches, the length of said surface in a direction along the longitudinal axis of the racket being between 45 and 58% of the total length of the racket, said surface in a direction generally perpendicular to said axis having a maximum width between 9 and 11½ inches, the center of percussion of the strung surface being approximately adjacent the geometric center thereof, the center of gravity of the racket being at a location between 48 and 52% of the total length of the racket as measured from the butt end of the handle grip, the racket having a weight of 12 to 15 ounces, the strung surface being oval, with the center thereof being defined by the intersection of the major and minor axis, the periphery of said surface being defined by said frame and a throat piece secured to the frame.

7. A tennis racket in accordance with claim 6 wherein the racket has a length of 26–27 inches, and the center of gravity being at a location corresponding to approximately 51% of the total length of the racket as measured from the butt end of the handle grip.

8. A tennis racket comprising a frame having a head connected to a handle grip so as to have a standard length of between 26 and 28 inches and a standard weight of between 12 and 15 ounces, said head having a strung surface of 85 to 130 square inches defined by nylon strings at a tension of 65 to 70 pounds and woven with a non-uniform pattern of spacing between adjacent strings, the size of openings between adjacent strings in a center portion of said surface being smaller than the size of similar openings adjacent the frame, the length of the head in a direction along the longitudinal axis of the racket being greater than the width of the central portion of the head in a direction generally perpendicular to said axis, the length of said surface being between 12 and 15 inches and the width of said surface being between 9½ and 11½ inches, the center of percussion of said racket being within one inch of the geometric center of said surface, and the center of gravity being at a location between 45 and 52% of the total length of the racket as measured from the butt end of the handle grip.

9. A tennis racket in accordance with claim 8 wherein said head is of uniform cross section free from any weights added to change the effective location of the center of gravity of the racket.

10. A tennis racket provided with a frame having a generally elliptical head adapted to be strung connected to a handle so as to have a standard length of between 26 and 28 inches and a standard weight of between 12 and 15 ounces with the center of gravity being located between 45 and 52% of the length measured from the butt end of the handle, said head having a radius of curvature of between 3 and 10 inches except for the flare at the throat, the improvement comprising means for substantially increasing the size of the zone of a coefficient of restitution in excess of .4, said means including the length of said head adapted to be strung being between 12 and 15 inches with the area of the inner periphery of said head being between 85 and 130 square inches, whereby the distance between the geometric center of said head and the center of percussion is reduced as a result of the increased length of the head along the major axis thereof.

11. A tennis racket comprising a frame having a generally elliptical head connected to a handle shaft so as to have an overall length of about 27 inches and a weight of 12 to 15 ounces, said head having a strung surface of 85 to 130 square inches, said strung surface having a zone greater than 8 square inches in area in which the coefficient of restitution is greater than .4 as measured on a racket supported vertically in a vise at the location of the handle grip and impacted with a tennis ball travelling perpendicular to said surface at an incoming speed of about 60 mph.

12. A tennis racket in accordance with claim 11 wherein said surface is strung with strings at a tension of between 65 and 70 pounds.

13. A tennis racket in accordance with claim 11 wherein said surface is strung with a non-uniform spacing so that the openings between adjacent strings at the central portion of said surface are smaller than corresponding openings close to the frame.

14. A tennis racket comprising a frame having a generally elliptical head connected to a handle shaft so as to have an overall length of about 27 inches and a weight of 12 to 15 ounces, said head having a strung surface of 85 to 130 square inches, said surface extending for at least 80% of the distance from the center of percussion to the center of gravity, the center of percussion being from zero to one inch from the geometric center of said surface.

15. A tennis racket in accordance with claim 14 wherein said surface is strung with strings at a tension of between 65 and 70 pounds.

16. A tennis racket in accordance with claim 15 wherein said strings are of nylon or gut.

17. A tennis racket comprising a frame having a generally elliptical head connected to a handle shaft so as to have an overall length of about 27 inches and a weight of 12 to 15 ounces, said head having a strung surface of 85 to 130 square inches, said strung surface having a zone between the center of percussion and the center of gravity wherein the coefficient of restitution is at least .6.

18. A tennis racket in accordance with claim 17 wherein said strung surface has a length of between 12 and 15 inches, and the distance between the geometric center of said surface and the center of percussion being between zero and one inch.

* * * * *

REEXAMINATION CERTIFICATE (442nd)

United States Patent [19]

Head

[11] B1 3,999,756

[45] Certificate Issued Dec. 24, 1985

[54] TENNIS RACKET

[75] Inventor: Howard Head, Baltimore, Md.

[73] Assignee: Prince Manufacturing, Inc., Princeton, N.J.

Reexamination Request:
No. 90/000,676, Dec. 3, 1984

Reexamination Certificate for:

| | |
|---|---|
| Patent No.: | **3,999,756** |
| Issued: | **Dec. 28, 1976** |
| Appl. No.: | **612,076** |
| Filed: | **Sep. 10, 1975** |

Related U.S. Application Data

[63] Continuation-in-part of Ser. No. 516,550, Oct. 21, 1974, abandoned.

[51] Int. Cl.[4] ..... A63B 49/02

[52] U.S. Cl. ..... 273/73 C; 273/73 D

[58] Field of Search ..... 273/73 R, 73 C, 73 D, 273/73 F, 73 H, 67 R, 29 A

[56] References Cited

U.S. PATENT DOCUMENTS

| | | | |
|---|---|---|---|
| D. 216,028 | 11/1969 | Cheris et al. | D34/5 |
| 322,268 | 7/1885 | Edge | 273/73 R X |
| 323,608 | 8/1885 | Turner | 273/73 D |
| 455,632 | 7/1891 | Malings | 273/73 D |
| 702,897 | 6/1902 | Boulanger | 209/161 |
| 880,306 | 2/1908 | Imlach | 273/73 E |
| 971,773 | 10/1910 | Mueller | 273/73 D |
| 1,122,159 | 12/1914 | Richey | 273/73 G |
| 1,132,214 | 3/1915 | Ries et al. | 273/73 D |
| 1,140,282 | 5/1915 | Parsons | 273/73 E |
| 1,173,712 | 2/1916 | DuBois | 273/73 D |
| 1,186,283 | 6/1916 | Coddington | 273/73 F |
| 1,292,317 | 1/1919 | Holding | 273/73 D |
| 1,409,621 | 3/1922 | Tournier | 273/73 D |
| 1,452,803 | 4/1923 | Harris | 273/73 H |
| 1,470,878 | 10/1923 | Robinson | 273/73 D |
| 1,502,845 | 7/1924 | Blache | 273/73 D |
| 1,531,862 | 3/1925 | Larned | 273/73 D |
| 1,532,991 | 4/1925 | De Meza | 273/73 G |
| 1,536,288 | 5/1925 | Freedlander et al. | 273/73 J X |
| 1,559,986 | 11/1925 | Quick | 273/73 E |
| 1,609,662 | 12/1926 | Rawlings et al. | 273/73 R |
| 1,621,746 | 3/1927 | Morten | 273/73 D |
| 1,637,583 | 8/1927 | Norton | 273/73 D |
| 1,665,598 | 4/1928 | May | 273/73 D |
| 1,687,322 | 10/1928 | Claremont | 273/73 D |
| 1,721,897 | 7/1929 | Cardwell | 273/73 C |
| 1,733,960 | 10/1929 | Godfrey | 273/73 D |
| 1,750,644 | 3/1930 | Norton | 273/73 J |
| 1,919,072 | 7/1933 | Munday | 273/73 H |
| 2,080,642 | 5/1937 | Timpe | 273/73 D |
| 2,085,960 | 7/1937 | Donisthorpe | 273/73 R |
| 2,109,525 | 3/1938 | Donisthorpe | 273/73 R |
| 2,152,239 | 3/1939 | Burnard | 273/76 |
| 2,165,701 | 7/1939 | Goerke | 273/73 E |
| 2,171,223 | 8/1939 | Robinson | 273/73 H |
| 2,178,588 | 11/1939 | Kleinman | 273/73 D |
| 2,193,526 | 3/1940 | Aubert | 273/73 E |
| 2,206,548 | 7/1940 | Goerke | 273/73 E |
| 2,236,414 | 3/1941 | Reach | 273/80 A |

List continued on next page.

FOREIGN PATENT DOCUMENTS

| | | | |
|---|---|---|---|
| 17636 | of 1929 | Australia | 53/2 |
| 2030998 | 12/1971 | Fed. Rep. of Germany | |
| 967300 | 10/1950 | France | 20/1 |
| 8004[U] | 5/1923 | Japan | 115/2 |
| 10204[U] | 7/1923 | Japan | 115/2 |
| 5258[U] | 6/1927 | Japan | 115/2 |
| 45-33929[U] | 12/1970 | Japan . | |
| 47-41566[U] | 12/1972 | Japan . | |
| 48-29970[U] | 4/1973 | Japan . | |
| 48-32714 | 10/1973 | Japan . | |
| 1314 | of 1884 | United Kingdom . | |
| 5457 | of 1884 | United Kingdom . | |
| 3127 | of 1885 | United Kingdom . | |
| 14147 | of 1885 | United Kingdom . | |
| 10851 | of 1907 | United Kingdom . | |
| 15393 | of 1908 | United Kingdom . | |
| 7210 | of 1910 | United Kingdom . | |
| 210485 | 2/1924 | United Kingdom . | |
| 219193 | 7/1924 | United Kingdom . | |
| 224964 | 11/1924 | United Kingdom . | |
| 252480 | 6/1926 | United Kingdom . | |
| 269955 | 5/1927 | United Kingdom . | |
| 287775 | 3/1928 | United Kingdom . | |
| 293123 | 7/1928 | United Kingdom . | |
| 331925 | 7/1930 | United Kingdom . | |
| 431394 | 7/1935 | United Kingdom . | |
| 449362 | 6/1936 | United Kingdom . | |

OTHER PUBLICATIONS

Brady, M., Lawn Tennis Encyclopedia, 1969.

Browne, M. K., Design for Tennis, 1949.

Burghard and Peznicek, Tennis Das Spiel Der Voelker, J. Gruneberg Verlag, Marburg, prior to 1938 (exact date unknown), p. 8 (translation attached).

Burrow, F. R., My Tournaments, 1923, pp. 276, 277, 306, 307.

Canepele, V., Il Tennis E La Technica, Editoriale Olimpia, Apr. 1943 XXI Stal. Grafici A Valecchi (translation attached).

List continued on next page.

*Primary Examiner*—Richard C. Pinkham
*Assistant Examiner*—Matthew L. Schneider

[57] ABSTRACT

The tennis racket has a strung surface which is larger than the strung surface of a conventional racket, particularly in regard to its dimension in a longitudinal direction from the frame tip toward the handle shaft of the racket. The conventional length, weight, and balance which have proven necessary for good playing characteristics for all tennis rackets of the past have been maintained. The racket has unexpectedly achieved increased strength and a combination of advantages in playing characteristics without resort to weights, springs, or other complications previously proposed. The racket has a zone of high coefficient of restitution, much larger than that of conventional rackets, extending in a longitudinal direction from the region of the center of percussion to a point 1¼ inch from the throat of the racket, thereby taking maximum advantage of the location of the center of percussion of the racket. The zone of high coefficient of restitution is also wider with respect to the corresponding zone on conventional rackets.

U.S. PATENT DOCUMENTS

| | | | |
|---|---|---|---|
| 2,268,893 | 1/1942 | Nielsen | 273/76 |
| 2,311,172 | 2/1943 | Hetzel | 273/73 E |
| 2,542,661 | 2/1951 | Godfrey | 273/73 D |
| 2,564,093 | 8/1951 | Bijl | 273/73 H X |
| 2,626,804 | 1/1953 | Robinson | 273/73 E |
| 2,742,289 | 4/1956 | Allward | 273/73 H |
| 2,795,426 | 6/1957 | Wood | 273/73 R |
| 2,843,384 | 7/1958 | Schmidt | 273/80 R |
| 3,239,224 | 3/1966 | Finn et al. | 273/73 R |
| 3,540,728 | 11/1970 | Palmer | 273/73 C |
| 3,547,440 | 12/1970 | Deer | 273/73 D |
| 3,582,073 | 6/1971 | Melnick et al. | 273/73 D |
| 3,625,512 | 12/1971 | Latham et al. | 273/73 C |
| 3,664,668 | 5/1972 | Held | 273/73 C |
| 3,702,701 | 11/1972 | Vaughn et al. | 273/73 H |
| 3,734,499 | 5/1973 | Goldstein | 273/73 E |
| 3,751,083 | 8/1973 | Jacobson et al. | 287/60 |
| 3,805,366 | 4/1974 | Vaughn et al. | 29/433 |
| 3,814,423 | 6/1974 | Shockley et al. | 273/73 C |
| 3,834,699 | 9/1974 | Pass | 273/73 D |
| 3,899,172 | 8/1975 | Vaughn et al. | 273/73 C |

OTHER PUBLICATIONS

Clerici, G., 500 Anni Di Tennis, Italy 1974, p. 31 and related figures (translation attached).
Cochet, H., The Art of Tennis, 1936.
Cummings, P., American Tennis, 1957, pp. 170–175.
Cutler, M. D., Inside Tennis, 1954.
Cutler, M. D., The Tennis Book, 1967.
Danzig, A. and Schwed, P., The Fireside Book Of Tennis, 1972.
Dewhurst, E. B., The Science Of Lawn Tennis, 1910.
Doeg, J. H. And Danzig, A., Elements Of Lawn Tennis, 1931.
Donisthorpe, F. W., Lawn Tennis And Badminton ("LTB") 2/25/33, pp. 1161–1162.
"The Mechanics Of Lawn Tennis For The Advanced And Thoughtful Player".
Donisthorpe, F. W., LTB, Mar. 4, 1933, p. 1186: "The Mechanics Of Lawn Tennis . . . "(cont'd).
Donisthorpe, F. W., LTB, Mar. 11, 1933, pp. 1211–1212: "The Mechanics Of Lawn Tennis . . . " (cont'd).
Donisthorpe, F. W., LTB, Mar. 18, 1933, pp. 1232–1233: "The Mechanics Of Lawn Tennis . . . " (cont'd).
Dorey, H. V., Who's Who In Lawn Tennis, 1920, p. 52.
Encyclopedia Americana, vol. 8, "Racket", 1927–1975, pp. 114–115.
Encyclopedia Britannica, vol. 18, "Racket", 1969 ed., first publ. 1768, pp. 992–993.
Fochek, F., Consumer Research Magazine, vol. 57, Apr. 1974, pp. 28–31: "How To Choose And Care For Your Tennis Racket".
Fukuda, M., The Tennis, 1937 Chuo Koron Publ., p. 21 (translation attached).
Grimsley, W., Tennis, Its History, People And Events, 1971.
Lamprecht, W. A., Tennis, No. 7/1955, pp. 155–156: "Tennisschlaeger Und Tennissaiten" (translation attached).
Lenglen, S., Lawn Tennis, The Game Of Nations, 1925.
De Manteuil, E., La Paume Et Le Lawn Tennis Libraire Hachette et CIE: Paris 1898.
O'Connell, G., Chicago Herald & Examiner 7/3/1937, p. 17.
Paret, J. P., Lawn Tennis, 1904, pp. 78–79.
Paret, J. P., Methods And Players Of Modern Lawn Tennis, 1915.
Parkus, H., Mechanik Der Festen Koerper, Springer, Vienna, 1966, pp. 348–351 (translation attached).
Patterson, N. H., The Complete Lawn Tennis Player, 1948.
Pfaundler, M., Die Principien Und Theorien Des Lawn Tennis Spieles, Wien and Leipzig, 1898, pp. 34–47 (translation attached).
Plagenhoef, S., Fundamentals Of Tennis, 1970, pp. 111–117, 121–125, 129 and 130.
Plagenhoef, S., Patterns Of Human Motion, 1971, pp. 77–88.
Robertson, M., The Encyclopedia Of Tennis, Jun. 17, 1974, pp. 36, 119, 222, 271, 298, and 322.
Shin-Nihon Sports, 3/8/59, p. 4 (translation attached).
Talbert, B., Tennis Observed, 1967.
Tingay, L., 100 Jahre Tennis, Verlag Limpert Frankfurt/M. 1973, pp. 10 and 11.
Unknown, The Illustrated Sporting And Dramatic News, Oct. 28, 1933.
Unknown, Lawn Tennis And Badminton, Jun. 5, 1919, p. 77: "Open Tournaments".
Unknown, Lawn Tennis And Badminton, Nov. 12, 1921, p. 541: "Mr. F. W. Donisthorpe".
US Lawn Tennis Association, Fifty Years Of Lawn Tennis In The United States, 1931, printed in only 1 ed. limited to 3,000 copies.
US Lawn Tennis Association, Official Encyclopedia of Tennis, 1972.
Watson, E. H. Lacon, Notes And Memories Of A Sports Reporter: Lawn Tennis Final Notes, 1931, pp. 5, 218–221, 284–287.
Whitman, M. D., Tennis Origins And Mysteries, 1932, pp. 37–40, 55–59.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-18 is confirmed.

* * * * *